United States Patent [19]

Nawrath

[11] Patent Number: 4,598,640

[45] Date of Patent: Jul. 8, 1986

[54] PRINTING UNIT FOR A WEB-FED OFFSET ROTARY PRESS

[75] Inventor: Nikolaus Nawrath, Igenhausen, Fed. Rep. of Germany

[73] Assignee: M.A.N. Roland Druckmaschinen Aktiengesellschaft, Offenbach am Main, Fed. Rep. of Germany

[21] Appl. No.: 720,524

[22] Filed: Apr. 5, 1985

[30] Foreign Application Priority Data

Apr. 5, 1984 [DE] Fed. Rep. of Germany ..... 3412812

[51] Int. Cl.[4] ..... B41F 7/02; B41L 17/18

[52] U.S. Cl. ..... 101/177; 101/180

[58] Field of Search ..... 101/177, 180, 182, 181, 101/184, 183, 185, 184, 220, 221, 247, 217, 218, 143, 144, 145

[56] References Cited

U.S. PATENT DOCUMENTS 3,470,816 10/1969 Piecha et al. ..... 101/218 X 3,527,165 9/1970 Harless ..... 101/220

FOREIGN PATENT DOCUMENTS 48103 3/1981 Japan ..... 101/182

*Primary Examiner*—J. Reed Fisher

*Attorney, Agent, or Firm*—Frishauf, Holtz, Goodman & Woodward

[57] ABSTRACT

In a web-fed offset rotary press printing unit comprising four cylinders (2–5), in order to move the two inner cylinders, for instance blanket cylinders (3, 4), apart from one another without having to move the outer cylinders (2, 5), the cylinder trunnions (6, 7) of the inner cylinders (3, 4) are positioned on double eccentric bushes (8, 9; 10, 11). By means of tie rods (16–19), all the pairs of eccentric bushes (8, 9; 10, 11) are pivoted in common about the same angle, resulting in a linear movement in opposite directions (P or P') by the inner cylinders (3, 4) with respect to the straight line (G) on which the four cylinders are disposed.

10 Claims, 3 Drawing Figures

1
2
3
4
5
6
7
8
9
10
11
12
12'
13
13'
14
14'
15
15'
16
17
18
18'
19
19'
20
21
21'
22
23
24
25
26"
27"
28
A
B
G
T
p
p'

PRINTING UNIT FOR A WEB-FED OFFSET ROTARY PRESS

The invention relates to a printing unit for a web-fed offset rotary press, or printing machine, in which four cylinders of the printing unit are disposed one above the other on a straight line extending obliquely with respect to an approximately horizontal web of material to be printed. The web can be fed between the two inner cylinders, which are embodied as rubber cylinders, and the cylinders can be moved apart from one another by means of eccentric adjusting means.

BACKGROUND

From German Patent Disclosure Document DE-OS 32 37 961.7-27, a web-fed offset rotary printing machine is already known which has a number of printing units of the above-specified type disposed in succession in it. If the two middle cylinder, as a rule the rubber blanket cylinders, of such printing units are to be separated from one another, for instance in order to fasten new blankets onto them, then at least one of the outer cylinders must first be pivoted out of the way. The trunnions of all the printing unit cylinders are supported in eccentric bushes, so that the desired positioning movements into and out of the position for printing can be executed in the appropriate sequence by rotating the eccentric bushes.

THE INVENTION

It is an object to enable separating the two middle cylinders in a printing unit of the above type using a single control mechanism, without having first to pivot the outer cylinders out of the way.

Briefly, the eccentric bushes of the middle cylinders are disposed in pairs, one inside the other, with each pair located in a bore in each middle cylinder and supported in the side walls; the pairs have the same eccentricity. The outer bushes of each pair are joined by one common tie rod, and the inner bushes of each pair are joined by another tie rod. By means of two further tie rods respectively joining one inner and one outer bush of a pair to a control device, all the eccentric bushes can be rotated about the same angle, causing the two middle cylinders to move in opposite directions, at right angles to the oblique straight line on which the printing unit cylinders are disposed when in operation. The outer cylinders of the printing unit do not need to be moved.

Although supporting the axial trunnions of a cylinder in a double eccenter in the side walls of a printing unit is already known from examined German Patent Application DE-AS 27 25 030, the pairs of eccentric bushes in that case are adjusted via two levers rotatable independently of one another; with these two levers, only one cylinder at a time is moved toward two adjacent cylinders or raised away from them. In the concept of a printing unit according to the invention, in contrast, there is the advantage that two middle cylinders, that is, two cylinders positioned between two outer cylinders that are disposed on approximately the same common center line, can be separated from and moved toward one another by using a single control device; in the course of this movement the middle, or blanket cylinders are separated from the associated outer cylinders, typically plate cylinders, as well. Hence it is no longer necessary for the outer cylinders to be positioned in such a way, for instance in an eccenter, that they are pivotable.

The invention will be described in further detail below, referring to the drawing.

DRAWINGS

FIG. 1 shows an example of a first embodiment of a printing unit in accordance with the invention; and FIGS. 2 and 3 show two further embodiments in which both inner cylinders have their centers of rotation at the right side of a theoretical line connecting the plate cylinders and in FIG. 3 at the left side of that theoretical line.

The structural components shown in all three Figures are identical and, thus, the same reference numerals have been used in all three Figures. Where appropriate, prime notation has been used for distinction between elements in respective embodiments.

DETAILED DESCRIPTION

Figure 1:
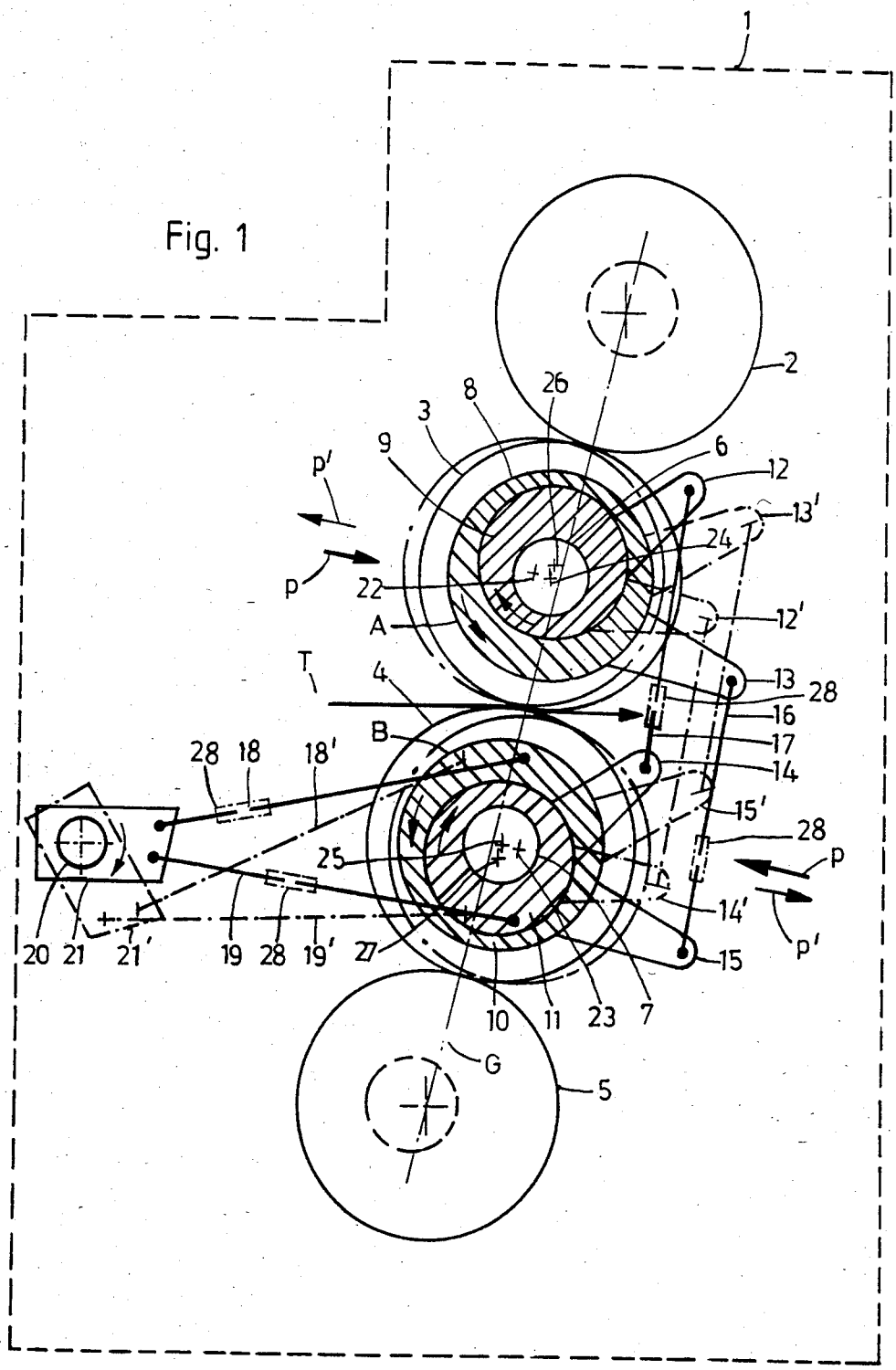

For multi-color printing on both sides of a web T of material to be printed, a plurality of printing units such as the unit 1 shown in the drawing may be disposed in succession. Such printing units each include four cylinders 2, 3, 4, 5 disposed one above the other and positioned approximately on a common center line G. The cylinders accordingly are supported on each other, so that the danger of sagging, with the attendant impairment of printing quality, is thereby avoided or lessened. As shown in the drawing, the web T that is to be printed is fed approximately horizontally through the two middle cylinders 3, 4, which are the rubber blanket cylinders, in order that the web will be printed on both sides. To assure that the web will properly wrap itself about the two inner cylinders 3, 4, the straight line G is more or less oblique; that is, it is not at right angles to the direction in which the web T moves. In the printing unit 1 according to the invention, it is no longer absolutely necessary for the two outer cylinders 2, 5, which in an offset printing unit are the plate cylinders, to be positioned in eccentric bearings; such a positioning is shown in the drawing in broken lines.

Bores A, B for supporting the two middle cylinders 3, 4 are provided in each side wall 1 of the printing unit shown, which is intended for a web-fed offset rotary press. In these bores, the cylinder trunnions 6, 7 of rubber blanket cylinders 3, 4 are positioned in respective pairs of eccentric bushes; these pairs comprise an eccentrically drilled outer bush 8 and an eccentrically drilled inner bush 9 for the cylinder trunnion 6, and an eccentrically drilled outer bush 10 and an eccentrically drilled inner bush 11 for the cylinder trunnion 7. One of a group of adjusting levers 12, 13, 14, 15 is associated with each of the eccentric bushes 8–11. The adjusting levers 12, 14 for the inner eccentric bushes 9, 11 are joined by a tie rod 17, and the adjusting levers 13, 15 for the outer eccentric bushes 8, 10 are joined by a tie rod 16. A control or adjusting device is also joined to one of the pairs, for instance the lower one, of eccentric bushes, and with the aid of this control device the eccentric bushes 10, 11 are rotatable via tie rods 18, 19. The movement of the tie rods 18, 19 and hence the rotation of the eccentric bushes 10, 11 is effected with the aid of a control device which includes a pivot lever 20 disposed on an adjusting spindle 21. The adjusting spindle 21 may be rotated by motor or manually. If the adjusting spindle 21 is rotated clockwise, for instance, the tie rods 16–19 assume the position indicated by broken lines, resulting in a corresponding rotation of the eccentric bushes 8–11. The adjusting levers 12–15 and the tie rods 16–19 are dimensioned such that all the eccentric bushes 8–11 are rotated by the same amount, that is, about the same angle, when the adjusting spindle 21 rotates. It is thereby assured that when the cylinders are moved into and out of their operational positions, the inner eccentric bush 9 is rotated by the same angular amount as the outer eccentric bush 8, but in the opposite direction. The same applies to the inner eccentric bush 11 and the outer eccentric bush 10. It would also be possible, however, for the tie rods 18, 19 to act directly upon the tie rods 16, 17.

By means of the above-described advantageous embodiment of the adjusting levers 12–15 and tie rods 16–19, it is attained that with a single control device 20, 21 and with the outer cylinders 2, 5 remaining stationary, the inner cylinders 3, 4 can be moved simultaneously, but in opposite directions P and P′ respectively, in a straight line toward or away from the common straight line G and at an angle of 90° thereto. This makes it possible to separate the inner cylinders 3, 4 from one another and from the cylinders 2, 5, by moving the upper inner cylinder 3 toward the left and the lower inner cylinder 4 toward the right. The cylinders 3, 4 are thus separated, for instance in order to change their rubber blankets. In the course of this movement, they also move away from the respective outer cylinders 2 and 5. If the movement is in the opposite direction, the inner cylinders 3, 4 are moved into their operational position; that is, they are each moved in the direction P toward the straight line G until they touch one another and also touch the outer cylinders 2 and 5, respectively. Although it is not absolutely necessary, it may be useful to support the outer cylinders eccentrically, as indicated by broken lines in the drawing. This also makes it possible to adjust the positioning force individually between the outer cylinder, such as 2, and the associated inner cylinder, such as 3, to the desired value.

Reference numerals 22, 23 indicate the centers of the cylinders 3, 4 in the separated or non-operational position, and reference numerals 24, 25 indicate the cylinder centers in the operational position. At the same time, reference numerals 24, 25 also indicate the center of the bore as well as the center of the inner eccentric bushes 9, 11; contrarily, reference numerals 26, 27 represent the centers of the bores of the outer eccentric bushes 8, 10. In summary, reference numerals 22, 23 show that the above-mentioned center points of the upper inner cylinder 3 always come to rest on the left side of the common straight line G, while the above-mentioned center points of the lower inner cylinder 4 come to rest on the right side of the common straight line G. As a result, upon a movement of the inner cylinders 3, 4 in the direction of the arrow P (positioning movement, i.e., an approach toward one another for operation), the cylinders 3, 4 can be positioned against one another with the required force. In the operational position, the cylinder centers 22, 23 should be as close as possible to the common straight line G.

The positioning force among the cylinders 2–5 is preferably not effected via the control device 20, 21.

The positioning force between the inner cylinders 3, 4 and between them and the respective outer cylinders 2, 5 is effected by means of the turnbuckles 28 located in the rods 16, 17, 18 and 19 and having a left-handed and right-handed threads. The turnbuckles extend or shorten the tie rods 16, 17, 18, 19 and thereby rotate the eccentric bushes 8, 9, 10 and 11 individually.

Figure 2:
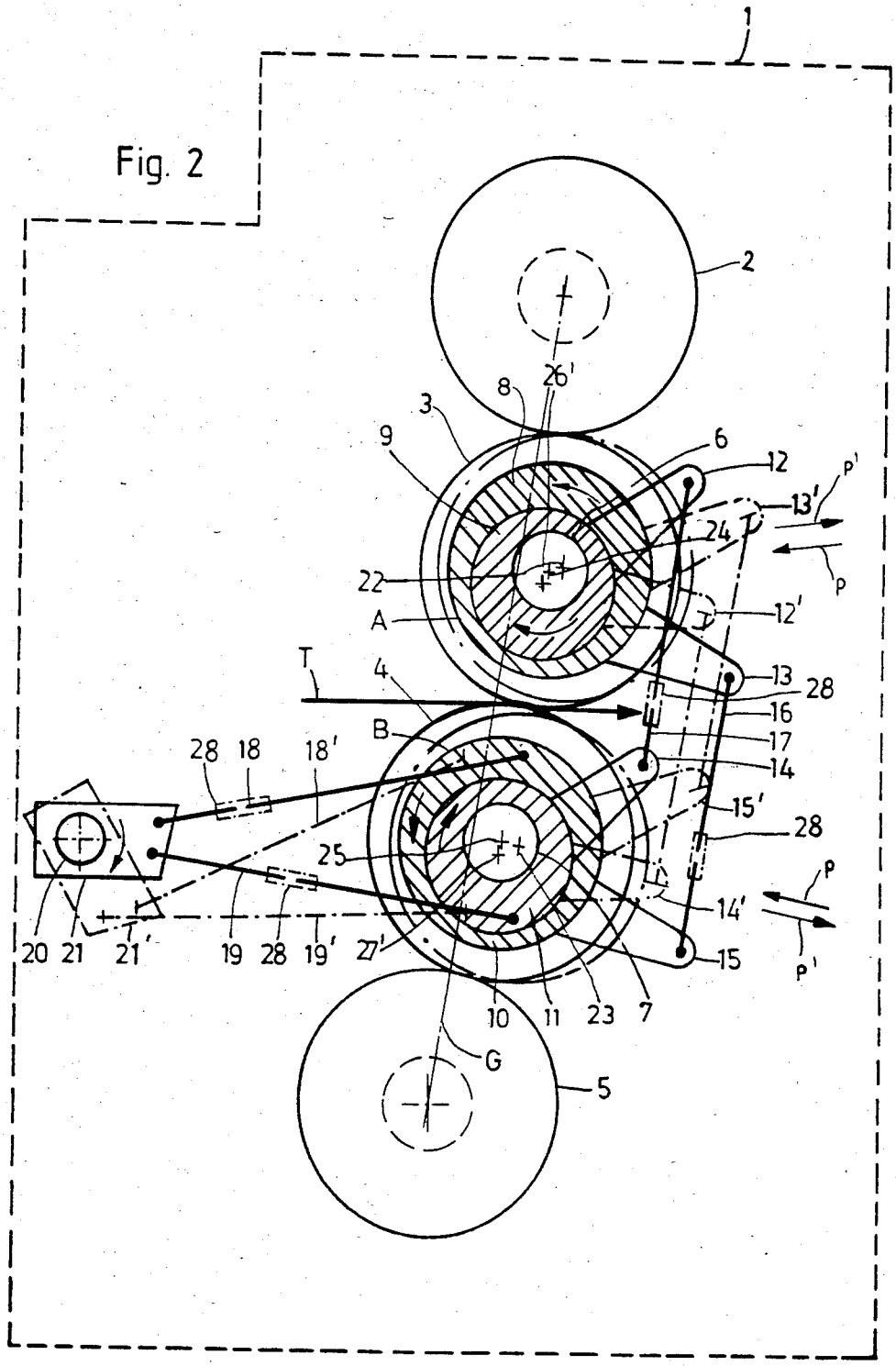
Figure 3:
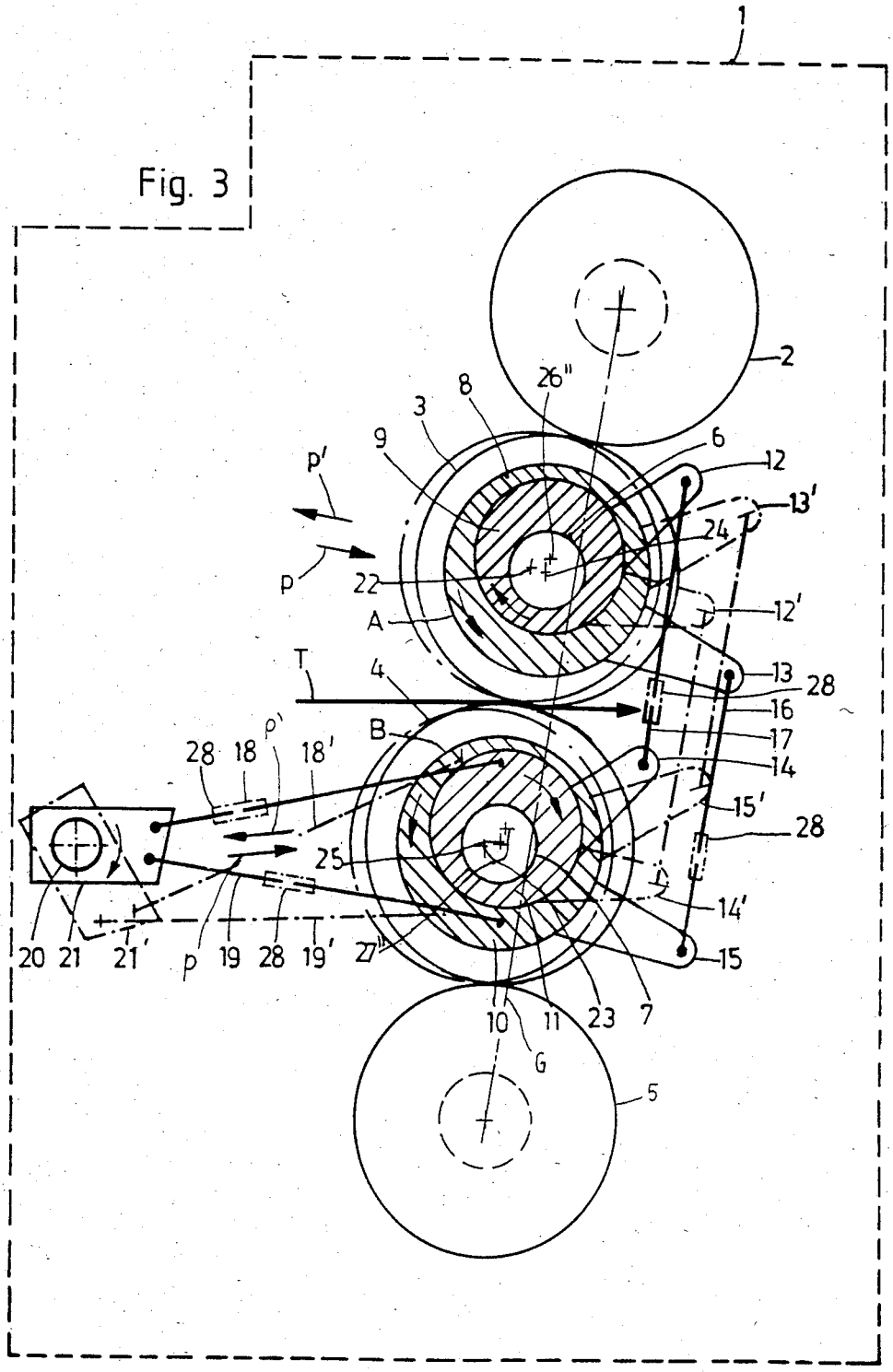

The difference between the embodiments of FIG. 1 and FIGS. 2 and 3 is the arrangement of the motion of switching the inner cylinders 3, 4 in the direction P or P′, respectively, with respect to the common line G. In FIG. 2, the movement is, slightly divergent, towards the right; in FIG. 3, the movement is, slightly divergent, towards the left. Of course, for engagement, the movement is reversed. By this arrangement, the cylinders 3, 4 are separated from each other and from the outer cylinders 2, 5. The switching arrangement is identical to that of FIG. 1; only the eccentric bushes have different positions which, specifically, differ by 180° from each other.

In the arrangement of FIGS. 2 and 3, likewise, it may be desirable to provide eccentric bushes for the outer cylinders 2, 5, but this is not necessary; likewise, the engagement force can be controlled by turnbuckles.

In FIGS. 2 and 3, the reference numerals 26′,27′ and 26″, 27″ correspond, respectively, to the reference numerals 26, 27 of FIG. 1, and relate to the center of the bores of the outer eccenter bushes 8, 10.

In the arrangement in accordance with FIGS. 2 and 3, the points designated by reference numerals 22, 27′ and 22, 27″, and hence the centers of the cylinders 3, 4, are either at the right side (FIG. 2) or at the left side (FIG. 3) of the theoretical connecting line G between the centers of the outer cylinders 2, 5. This insures movement of the inner cylinders 3, 4, in direction of the arrow P for engagement, and permits engaging the cylinders 3, 4, with the necessary impression force with respect to each other. Preferably, the centers of the cylinders, shown at reference points 24, 25, should be close to the common theoretical line G. In the embodiments of FIGS. 2 and 3, it is desirable that the outer cylinders 2, 5 are slightly offset laterally with respect to the theoretical line G; in FIG. 2, the offset would be towards the left, in FIG. 3, the offset would be towards the right. This facilitates movement of the inner cylinders 3, 4, towards the right (FIG. 2) or towards the left (FIG. 3) when it is desired to separate the cylinders. Although the theoretical connecting line G is shown to pass through the centers, the line G may also be thought of as passing through the tangential engagement points between the cylinders 2, 5 and the engaging cylinders 3, 4, when in engaged position.

Various changes and modifications may be made within the scope of the inventive concept.

I claim:

1. A printing unit for a rotary offset printing machine having side walls (1) formed with bores (A, B) therein;

four printing cylinders (2, 3, 4, 5) located one above another between the side walls, the centers of the printing cylinders being located close to a straight line extending obliquely with respect to the path of printed substrate that can be fed between the two inner cylinders (3, 4), said two inner cylinders having extending trunnions (6, 7) and forming blanket cylinders, and comprising, in accordance with the invention, means for separating the inner blanket cylinders (3, 4) from each other without effectively changing the position of the outer cylinders (2, 5) comprising two eccentric bushes (8, 9; 10, 11) positioned within each other and located in the bores (A, B) in the printing unit side wall, the inner ones (9, 11) of the eccentric bushes retaining the trunnions (6, 7) of the inner or blanket cylinder (3, 4);

said eccentric bushes (8, 9; 10, 11) having substantially the same eccentricity;

a first common tie rod (16) joining the outer eccentric bushes (8, 10);

a second common tie rod (17) joining the inner eccentric bushes (9, 11);

a first control rod (18) joined to at least one of the outer eccentric bushes (7, 8);

a second control rod (19) joined to at least one of the inner eccentric bushes (9, 11);

and an adjusting device (20, 21) coupled to said first and second control rods to shift the control rods, and to thereby rotate the eccentric bushes (8, 9; 10, 11) by essentially the same angular amount within the bores (A, B) so that the blanket cylinders (3, 4) will each move with respect to the straight line (G);

the axial centers (24) of the cylinder trunnions (6, 7) being located at a position on or at least close to and only slightly spaced from said straight line (G).

2. A printing unit according to claim 1, wherein said distance of the axial centers (24, 25) of the cylinder trunnions (6, 7) is small in relation to the diameter of the trunnions.

3. A printing unit according to claim 1, wherein (FIG. 1) the axial centers (24, 25) of the cylinder trunnions (6, 7) are located on different sides of said straight line (G).

4. A printing unit according to claim 1, wherein (FIGS. 2, 3) the axial centers (24, 25)of the cylinder trunnions (6, 7) are located at the same side with respect to the straight line (G).

5. A printing unit according to claim 1, wherein the adjusting device (20, 21) comprises a spindle (21) and a pivot lever (20) secured to the spindle, said control rods being connected to the pivot lever.

6. A printing unit according to claim 1, further comprising control levers (12, 13; 14, 15) coupled to each of the eccentric bushes (8, 9, 10, 11) and projecting therefrom in a radial direction;

and wherein said first and second common tie rods have end portions thereof connected to respective control levers of the inner and outer bushes.

7. A printing unit according to claim 6, further including turnbuckles interposed in the respective tie rods for controlling the impression force exerted between the blanket cylinders on the printing substrate and for adjusting the length of the respective tie rods.

8. A printing unit according to claim 1, wherein the inner and outer ones of the eccentric bushes, located within each other, are positioned in essentially coplanar arrangement, nested within each other.

9. A printing unit according to claim 1, wherein all said eccentric bushes are located in essentially a single plane.

10. A printing unit according to claim 1, wherein two each of the eccentric bushes (8, 9; 10, 11) are, respectively, nested within each other, the outer one of said bushes being retained within a respective bore (A, B) in the side wall, and said inner one of the bushes retaining the trunnion of the respective blanket cylinder.

* * * * *